US012662879B2

(12) United States Patent
Liu et al.

(10) Patent No.: US 12,662,879 B2
(45) Date of Patent: Jun. 23, 2026

(54) MECHANICAL HYDRAULIC TORQUE CONVERTER FOR HORIZONTAL WELL

(71) Applicant: Southwest Petroleum University, Chengdu (CN)

(72) Inventors: Yang Liu, Chengdu (CN); Junhong Wu, Chengdu (CN); Tianshou Ma, Chengdu (CN); Kun Ai, Chengdu (CN); Haijun Tao, Chengdu (CN); Xingyun Xiang, Chengdu (CN); Chao Fang, Chengdu (CN); Jiahua Zhang, Chengdu (CN)

( * ) Notice: Subject to any disclaimer, the term of this patent is extended or adjusted under 35 U.S.C. 154(b) by 0 days.

(21) Appl. No.: 19/215,303

(22) Filed: May 21, 2025

(65) Prior Publication Data

US 2025/0369287 A1 Dec. 4, 2025

(30) Foreign Application Priority Data

May 28, 2024 (CN) ..... 202410668646.0

(51) Int. Cl.
*E21B 4/02* (2006.01)
*E21B 4/00* (2006.01)

(52) U.S. Cl.
CPC ..... *E21B 4/02* (2013.01); *E21B 4/003* (2013.01)

(58) Field of Classification Search
CPC ..... E21B 4/02; E21B 4/003
See application file for complete search history.

(56) References Cited

U.S. PATENT DOCUMENTS 5,934,383 A * 8/1999 Jurgens ..... E21B 47/01 175/45
8,567,528 B2 * 10/2013 Comeau ..... E21B 4/16 175/73

(Continued)

FOREIGN PATENT DOCUMENTS

CN 111852334 A 10/2020
CN 115012823 A 9/2022
CN 117927134 A 4/2024

OTHER PUBLICATIONS

Flexible Shaft, Wikipedia—The Free Encyclopedia, Accessed on Dec. 19, 2025, this document is provided in response to Applicant's citation to Wikipedia regarding flexible shafts (Year: 2025).*

*Primary Examiner* — Tara Schimpf
*Assistant Examiner* — Ursula Lee Norris
(74) *Attorney, Agent, or Firm* — Nitin Kaushik

(57) ABSTRACT

This invention relates to a mechanical hydraulic torque converter for horizontal well drilling, and belongs to the technical field of oil and gas drilling tools. The hydraulic torque converter includes a driving shaft, an upper-shell, a driving shaft positioning shell, a TC bearing assembly, a universal shaft shell, a universal shaft assembly, a stator shell, a hollow rotor, a middle-shell, a torque separation assembly, a lower connector, and a confluence assembly. The universal shaft assembly is mounted in the universal shaft outer shell, and two ends of the universal shaft assembly are respectively connected with the driving shaft and the hollow rotor. One end of the confluence assembly is connected with the torque separation assembly, and the other end of the confluence assembly is communicated with an outlet of the lower connector. The tool is jointly driven by the rotating speed of upper drill string and drilling fluid displacement.

8 Claims, 13 Drawing Sheets

(56) References Cited

U.S. PATENT DOCUMENTS

| | | | | |
|---|---|---|---|---|
| 9,556,678 | B2 * | 1/2017 | Schaaf | E21B 7/067 |
| 2018/0252039 | A1 * | 9/2018 | Campbell | E21B 7/068 |
| 2020/0347676 | A1 * | 11/2020 | von Gynz-Rekowski | E21B 7/24 |

* cited by examiner 8
10
12
14
16
18
20
22
24
26
28
30
32
34
36
38
40
42
44
46
48
50
52
54
56
58
60
62
64
66
68
70
72
74
76
78
80
82
84
86
88

MECHANICAL HYDRAULIC TORQUE CONVERTER FOR HORIZONTAL WELL

CROSS-REFERENCE TO RELATED APPLICATIONS

The application claims priority to Chinese patent application No. 202410668646.0, filed on May 28, 2024, the entire contents of which are incorporated herein by reference.

TECHNICAL FIELD

The present invention relates to a mechanical hydraulic torque converter for a horizontal well, and belongs to the technical field of oil and gas resource drilling tools.

BACKGROUND

The effective utilization of unconventional oil and gas is of key strategic significance in alleviating the contradiction between oil and gas supply and demand, guaranteeing energy security in China, facilitating low-carbon transformation of the energy structure, and promoting carbon sequestration. The horizontal well is an important means for realizing the scale-benefit development of unconventional oil and gas resources such as shale gas. However, horizontal well drilling generally faces the problems such as high frictional force of the drill string, severe back pressure effect, low directional drilling efficiency, which has become one of the technological bottlenecks restricting the optimal and fast drilling of the horizontal well for unconventional oil and gas. Mechanical drag reduction technology is an effective means for reducing drilling friction resistance of the horizontal well and improving the directional operation efficiency, but its drag reduction performance varies under different well conditions. Comprehensively, the drag reduction effects of different drag reduction technologies are as follows: rotary steering drilling system>pipe-rocking drilling system>hydraulic oscillator. To this end, the operation advantages of rotary guidance and low-cost curved screws are combined to design a hydraulic torque converter drilling tool based on differential-pressure control that is capable of extracting oil and gas resources in a cost-effective and efficient manner.

Currently, in the document disclosed in China, in comparison with the patent CN115467907, when switching the working mode, the tool needs to be lifted a distance from the bottom of the well, and then a control instruction is sent to the tool to switch the working mode of the tool through electrical components. According to the present invention, mechanical rotating speed control is adopted, which avoids a problem of failure of an electrical element in a complex downhole environment, and has a relatively high safety coefficient. Meanwhile, in the patent CN116291247, a spring piston serves as a switch assembly, the pressure of the drilling fluid is used for driving a switch of the spring piston to realize switching of the working mode. According to the present invention, the nozzle-hole type differential pressure controller is adopted, which avoids a situation that the spring is rusted and fails due to drilling fluid corrosion, and has a relatively long service life.

SUMMARY

In view of the problems in the prior art, a purpose of the present invention is to provide a mechanical hydraulic torque converter for a horizontal well.

A technical solution provided by the present invention to solve the technical problem is as follows: a mechanical hydraulic torque converter for a horizontal well, including a hollow driving shaft, an upper outer shell, a driving shaft positioning shell, a TC bearing assembly, a universal shaft outer shell, a universal shaft assembly, a stator outer shell with a screw stator, a hollow rotor, a middle outer shell, a torque separation assembly, a lower connector, and a confluence assembly;

the driving shaft is mounted and fixed in the upper outer shell through the driving shaft positioning shell and the TC bearing assembly; and the universal shaft assembly is mounted in the universal shaft outer shell, and two ends of the universal shaft assembly are respectively connected with the driving shaft and the hollow rotor;

the universal shaft assembly is provided with a diversion hole and a diversion cavity, a flow channel of the driving shaft is communicated with the diversion cavity, and the diversion cavity is communicated with a gap between the universal shaft outer shell and the universal shaft assembly through the diversion hole;

the hollow rotor is mounted in the stator outer shell, one end of the hollow rotor is connected and communicated with the torque separation assembly mounted in the middle outer shell, and a drainage hole is formed in the other end of the hollow rotor; and a flow channel of the hollow rotor is communicated with a gap between the hollow rotor and the stator outer shell through the drainage hole;

a left end of the lower connector is provided with an outlet, and a right end of the lower connector is provided with a cavity communicated with the outlet; the confluence assembly is mounted in the cavity of the lower connector, one end of the confluence assembly is connected and communicated with the torque separation assembly, the other end of the confluence assembly is communicated with the outlet of the lower connector, and a confluence hole communicated with the cavity is formed in the confluence assembly; and the upper outer shell, the universal shaft outer shell, the stator outer shell, the middle outer shell, and the lower connector are sequentially connected.

The further technical solution is as follows: the TC bearing assembly includes a TC bearing moving ring, a lower baffle ring, an upper baffle ring, an upper sleeve, a TC bearing, a TC bearing static ring, and a bearing baffle ring, the TC bearing moving ring, the lower baffle ring, the upper baffle ring, the TC bearing, and the bearing baffle ring are sequentially sleeved on the driving shaft, the upper sleeve is sleeved on the lower baffle ring and the upper baffle ring, and right ends of the upper baffle ring and the upper sleeve are both tightly attached to a left end surface of the TC bearing; the driving shaft positioning shell is sleeved on the TC bearing moving ring and is in threaded connection with an interior of the upper outer shell, and a left end of the driving shaft positioning shell is tightly attached to a left end of the upper sleeve; the TC bearing static ring is sleeved on the bearing baffle ring, and a left end of the TC bearing static ring is tightly attached to a right end surface of the TC bearing; and a right end of the bearing baffle ring is tightly attached to a left end of the universal shaft assembly.

The further technical solution is as follows: the universal shaft assembly includes an upper portion of the universal shaft, a middle portion of the universal shaft, a lower portion of the universal shaft, and two cross shafts; the upper portion of the universal shaft, the middle portion of the universal shaft, and the lower portion of the universal shaft are all hinged to the cross shaft, and the lower portion of the universal shaft is in threaded connection with the hollow rotor; the upper portion of the universal shaft is provided with a channel in communication with the driving shaft and a diversion hole, and the channel is communicated with a cavity between the universal shaft outer shell and the universal shaft assembly through the diversion hole; and the upper portion of the universal shaft is in threaded connection with the driving shaft, and the lower portion of the universal shaft is in threaded connection with the hollow rotor.

The further technical solution is as follows: the confluence assembly includes a confluence connector, and a plurality of confluence holes are formed in the confluence connector in a radial direction.

The further technical solution is as follows: the confluence assembly includes a first drilling fluid converging pipe and a second drilling fluid converging pipe which are connected to each other, the first drilling fluid converging pipe and the second drilling fluid converging pipe are mounted in the cavity of the lower connector, two ends of the first drilling fluid converging pipe are respectively communicated with an outlet and the second drilling fluid converging pipe, one end of the second drilling fluid converging pipe is connected and communicated with the torque separation assembly, a differential pressure controller sleeved on the second drilling fluid converging pipe is arranged between an inner wall of the cavity of the lower connector and an outer wall of the second drilling fluid converging pipe, and a confluence hole communicated with the cavity of the lower connector is formed in the second drilling fluid converging pipe.

The further technical solution is as follows: the torque separation assembly includes a left pump rotor conversion connector, a left pump flexible shaft, a left end cover, a rotary sealing outer shell, a lining, a right pump rotor conversion connector, a right pump flexible shaft, and a right end cover;

the left pump rotor conversion connector, the left pump flexible shaft, the lining, the right pump flexible shaft, and the right pump rotor conversion connector are all axially provided with flow channels and are sequentially communicated; and the left pump flexible shaft and the right pump flexible shaft are respectively mounted in a left end and a right end of the lining, the lining is mounted in the rotary sealing outer shell, and the left end cover and the right end cover are respectively sleeved on the left pump flexible shaft and the right pump flexible shaft and are mounted on a left end and a right end of the rotary sealing outer shell; a left end of the left pump rotor conversion connector is connected with the hollow rotor, and a right end of the left pump rotor conversion connector is connected with the left pump flexible shaft; and a left end the right pump rotor conversion connector is connected with the right pump flexible shaft, and a right end of the right pump rotor conversion connector is connected with the confluence assembly.

The further technical solution is as follows: a pump rotor sealing ring is arranged between the left pump rotor conversion connector and the hollow rotor, and between the confluence assembly and the right pump rotor conversion connector.

The further technical solution is as follows: a conversion connector gasket is arranged between the left pump rotor conversion connector and the left pump flexible shaft, and between the right pump rotor conversion connector and the right pump flexible shaft.

The further technical solution is as follows: both the left pump rotor conversion connector and the left pump flexible shaft, and the right pump rotor conversion connector and the right pump flexible shaft are connected through a bolt.

The further technical solution is as follows: a rotary sealing ring is arranged between the rotary sealing outer shell and the left end cover and between the rotary sealing outer shell and the right end cover.

The present invention has the following beneficial effects: According to the present invention, the tool is jointly driven by the rotating speed of an upper drill string and the flow of drilling fluid, and when the displacement of the drilling fluid is determined, parameters can be adjusted according to the reference plate of weight on bit-rotating speed-output torque, so that drag reduction performance and directional operation efficiency of the tool are guaranteed.

Figure 1:
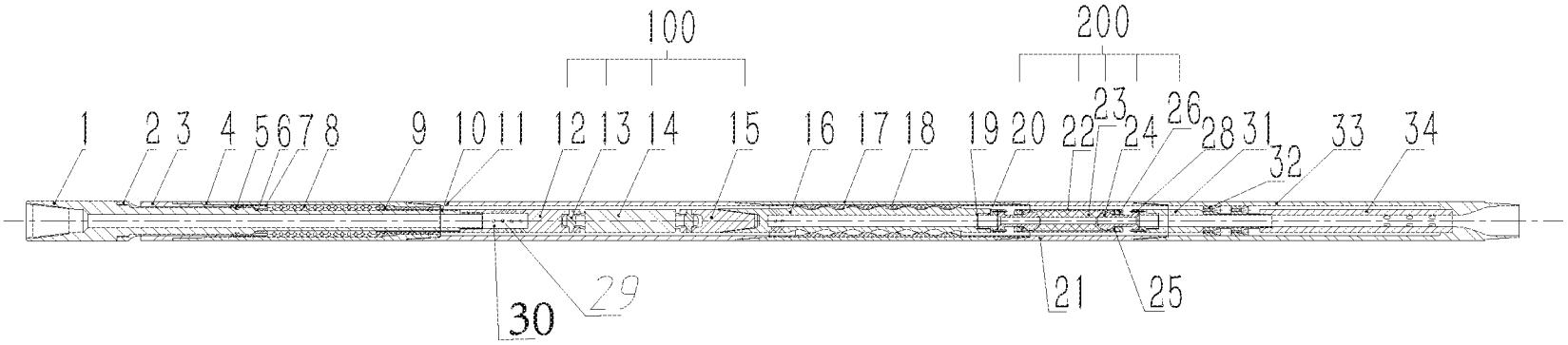
FIG. 1 is a schematic structural diagram of an embodiment of the present invention.

In the figures: 1—driving shaft; 2—TC bearing moving ring; 3—driving shaft positioning shell; 4—upper outer shell; 5—lower baffle ring; 6—upper baffle ring; 7—upper sleeve; 8—TC bearing; 9—TC bearing static ring; 10—bearing baffle ring; 11—universal shaft outer shell; 12—upper portion of the universal shaft; 13—cross shaft; 14—middle portion of the universal shaft; 15—lower portion of the universal shaft; 16—hollow rotor; 17—stator outer shell; 18—screw stator; 19—pump rotor sealing ring; 20—left pump rotor conversion connector; 21—middle outer shell; 22—rotary sealing outer shell; 23—lining; 24—right pump flexible shaft; 25—rotary sealing ring; 26—right end cover; 27—confluence connector; 28—bolt; 29—diversion hole; 30—diversion cavity; 31—second drilling fluid converging pipe; 32—differential pressure controller; 33—lower connector; 34—first drilling fluid converging pipe; 100—universal shaft assembly; 161—drainage hole; 162—flow channel of the hollow rotor; 331—outlet of the lower connector; 332—cavity of the lower connector; 300—confluence assembly; 341—confluence hole; 200—torque separation assembly; 210—left pump flexible shaft; 220— right pump rotor conversion connector; 230—left end cover; 240—conversion connector gasket.

DETAILED DESCRIPTION OF THE EMBODIMENTS

An explicit and complete description of the technical solutions in the present invention will be given below in conjunction with the accompanying drawings. Apparently, the described embodiments are part, but not all, of the embodiments of the present invention. Based on the embodiments in the present invention, all other embodiments obtained by those of ordinary skill in the art without making creative labor fall within the scope of protection of the present invention.

In the description of the present invention, it should be noted that, the orientations or positional relationships indicated by the terms "center", "up", "down", "left", "right", "vertical", "horizontal", "inside", "outside", etc. are based on those shown in the accompanying drawings, intended only for the convenience of describing the present invention and for simplifying the description, and not intended to indicate or imply that the referred apparatus or element must be provided with a particular orientation or constructed and operated with a particular orientation, therefore not allowed to be construed as a limitation of the present invention. Furthermore, the terms "first", "second", "third" are used for descriptive purposes only and not allowed to be construed as indication or implication of relative importance.

In the description of the present invention, it should be noted that, unless otherwise explicitly provided and limited, the terms "mounted", "attached", and "connected" should be understood in a broad sense, e.g., it may be a fixed connection, a detachable connection, or an integral connection; and it may be a mechanical connection. For those of ordinary skill in the art, the specific meanings of the above-mentioned terms in the present invention can be construed according to specific cases.

In addition, the technical features involved in different embodiments of the present invention described below can be combined with each other as long as they do not conflict with each other.

The present invention provides a mechanical hydraulic torque converter for a horizontal well, including a hollow driving shaft 1, an upper outer shell 4, a driving shaft positioning shell 3, a TC bearing assembly, a universal shaft outer shell 11, a universal shaft assembly 100, a stator outer shell 17 with a screw stator 18, a hollow rotor 16, a middle outer shell 21, a torque separation assembly 200, a lower connector 33, and a confluence assembly 300;

the driving shaft 1 is mounted and fixed in the upper outer shell 4 through the driving shaft positioning shell 3 and the TC bearing assembly; and the universal shaft assembly 100 is mounted in the universal shaft outer shell 11, and two ends of the universal shaft assembly 100 are respectively connected to the driving shaft 1 and the hollow rotor 16;

the universal shaft assembly 100 is provided with a diversion hole 29 and a diversion cavity 30, a flow channel of the driving shaft 1 is communicated with the diversion cavity 30, and the diversion cavity 30 is communicated with a gap between the universal shaft outer shell 11 and the universal shaft assembly 100 through the diversion hole 29; and a tail end of the diversion cavity 30 is closed, and the purpose of this arrangement is to ensure that after the drilling fluid flows through a flow guide connector, all the drilling fluid flows to the screw composed of the hollow rotor and the screw stator along an inner wall of the outer shell;

the hollow rotor 16 is mounted in the stator outer shell 17, one end of the hollow rotor is connected and communicated with the torque separation assembly 200 mounted in the middle outer shell 21, and a plurality of radially distributed drainage holes 161 are formed in the other end of the hollow rotor;

a left end of the lower connector 33 is provided with an outlet 331, and a right end of the lower connector is provided with a cavity 332 communicated with the outlet 331; the confluence assembly 300 is mounted in the cavity 332 of the lower connector 33, one end of the confluence assembly 300 is connected and communicated with the torque separation assembly 200, the other end of the confluence assembly 300 is communicated with the outlet 331 of the lower connector 33, and a confluence hole 341 communicated with the cavity 332 is formed in the confluence assembly 300; and the upper outer shell 4, the universal shaft outer shell 11, the stator outer shell 17, the middle outer shell 21, and the lower connector 33 are sequentially connected.

In the above embodiment, the mechanical hydraulic torque converter for a horizontal well mainly consists of a power section, a coupling section, and a differential pressure control section.

The power section mainly consists of the driving shaft 1, the driving shaft positioning assembly, the TC bearing assembly, and the upper outer shell 4.

A lower portion of the driving shaft is in threaded connection with the universal shaft assembly 100, and a plurality of diversion cavities distributed in a radial direction are formed in the universal shaft assembly 100. When the driving shaft 1 rotates, torque may be transmitted to the universal shaft assembly 100. Meanwhile, the drilling fluid flowing through the flow channel of the driving shaft 1 completely flows into the cavity between the universal shaft assembly 100 and the universal shaft outer shell 11 through the diversion hole 29 under the action of centrifugal force; and the coupling section mainly consists of the universal shaft outer shell 11, the universal shaft assembly 100, the hollow rotor 16, the stator outer shell 17, and the torque separation assembly 200.

The structure of the driving shaft 1 is similar to a hollow three-stage driving shaft, and a rod body of the driving shaft is sequentially divided into a first stage rod, a second stage rod, and a third stage rod according to a size of the outer diameter. A top portion of the first stage rod is in threaded connection with the upper drill string to ensure power input of the tool; an arc-shaped groove is formed in a tail end of the second stage rod and is used for being matched with the driving shaft positioning shell 3 to ensure that the driving shaft 1 cannot axially move relative to other components in the tool; a middle portion of the third stage rod is in interference fit with the TC bearing assembly shell to ensure the transmission of the drilling pressure, and meanwhile, the driving shaft 1 can rotate relative to the upper outer shell 4; and a tail end of the third stage rod is in threaded connection with the universal shaft assembly 100, so that the driving shaft 1 can transmit the torque to the universal shaft assembly 100; and the universal shaft assembly 100 is in threaded connection with the hollow rotor 16, the plurality of radially distributed drainage holes 161 are formed in the hollow rotor 16, so that a part of the drilling fluid flows into a cavity of a screw motor between the stator outer shell 17 and the hollow rotor 16, and the other part of the drilling fluid is drained into the flow channel 162 of the hollow rotor 16. A tail end of the hollow rotor is in threaded connection with a conversion connector in the torque separation assembly 200.

The differential pressure control section mainly consists of the confluence assembly 300 and the lower connector 33; and the confluence hole 341 is formed in the confluence assembly 300, so as to facilitate converging of the drilling fluid into a lower drilling tool; and the specific working process is as follows:

the drilling fluid flows from an internal flow channel of the driving shaft 1, passes through the diversion hole 29, and then flows into an annular cavity between the universal shaft assembly 100 and the universal shaft outer shell 11. When the drilling fluid flows through the drainage hole 161 in the upper portion of the hollow rotor 16, a part of the drilling fluid flows into the internal flow channel 162 of the hollow rotor 16 through the drainage hole 161, and the remaining drilling fluid flows into a screw clearance cavity formed by the hollow rotor 16 and the screw stator 18. The liquid flowing to the screw clearance cavity is determined by a rotating speed of the hollow rotor 16, and the faster the rotating speed of the hollow rotor 16, the more drilling fluid flows into the screw clearance cavity. The drilling fluid that ultimately flows into the screw clearance cavity and the drilling fluid in the internal flow channel 162 of the hollow rotor are re-gathered together at the confluence assembly 300 and flow to the lower drill string.

When the upper drill string drives the hollow rotor 16 to rotate through the driving shaft 1, a part of the drilling fluid is sucked into the screw clearance cavity, and the other part of the drilling fluid flows into the internal flow channel 162 of the hollow rotor 16 through the drainage hole 161. Under the condition that the pressure loss along the way of the drilling fluid is ignored, the pressure of the drilling fluid in the hollow rotor flow channel is approximately equal to the pressure of the drilling fluid at an outlet of the clearance cavity. Due to the effect of the drainage hole 161, the pressure of the drilling fluid at an inlet of the clearance cavity is larger than the pressure of the drilling fluid of the internal flow channel 162 of the hollow rotor 16, so that a fluid pressure difference is generated at two ends of the screw stator 18. Due to a shape of an inner wall of the screw stator, under the effect of the pressure difference of the drilling fluid, the screw stator 18 outputs a torque to the outer shell, and the torque value is jointly determined by the pressure difference between at the two ends of the clearance cavity and a shape of the screw. In the working process of the tool, the working factors affecting the pressure difference between the two ends of the clearance cavity mainly include the rotating speed of the upper drill string and the displacement of the drilling fluid. That is, the output torque of the tool can be adjusted by adjusting the rotating speed of the upper drill string and the displacement of the drilling fluid.

When the drilling operation needs to be guided, in order to ensure a stable tool face angle, the lower drill string needs to be kept in a sliding drilling state, and the magnitude of the output torque of the tool can be controlled by adjusting the displacement of drilling fluid and rotating speed of the drill string. When the output torque of the tool fluctuates up and down on the reactive torque of bit, the lower drill string can be kept in a sliding drilling state, and the floating range of the output torque depends on the friction torque range of the lower drill string.

When a straight well section is drilled, the lower drill string needs to rotate, so that friction resistance of the drill string is further reduced. The rotating speed of the upper drill string and the displacement of the drilling fluid is adjusted to enable the output torque of the tool to be larger than the sum of the reactive torque of bit and the friction torque of the lower drill string, so that the lower drill string can rotate.

Figure 2:
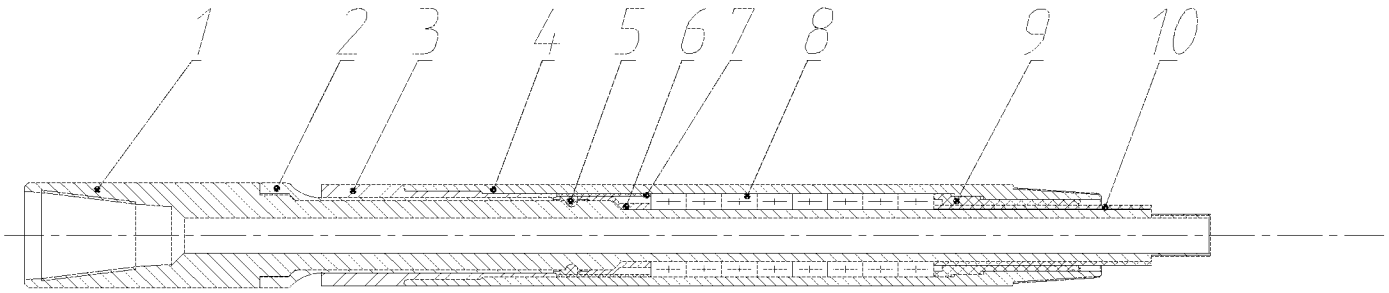
FIG. 2 is a schematic diagram of an upper outer shell and an internal structure thereof.

As shown in FIG. 2, in this embodiment, a specific implementation of the TC bearing assembly is that the TC bearing assembly includes a TC bearing moving ring 2, a lower baffle ring 5, an upper baffle ring 6, an upper sleeve 7, a TC bearing 8, a TC bearing static ring 9, and a bearing baffle ring 10. The TC bearing moving ring 2, the lower baffle ring 5, the upper baffle ring 6, the TC bearing 8, and the bearing baffle ring 10 are sequentially sleeved on the driving shaft 1, the upper sleeve 7 is sleeved on the lower baffle ring 5 and the upper baffle ring 6, and right ends of the upper baffle ring 6 and the upper sleeve 7 are both tightly attached to a left end surface of the TC bearing 8; the driving shaft positioning shell 3 is sleeved on the TC bearing moving ring 2 and is in threaded connection with an interior of the upper outer shell 4, and a left end of the driving shaft positioning shell 3 is tightly attached to a left end of the upper sleeve 7; the TC bearing static ring 9 is sleeved on the bearing baffle ring 10, and a left end of the TC bearing static ring is tightly attached to a right end surface of the TC bearing 8; and a right end of the bearing baffle ring 10 is tightly attached to a left end of the universal shaft assembly 100.

Figure 3:
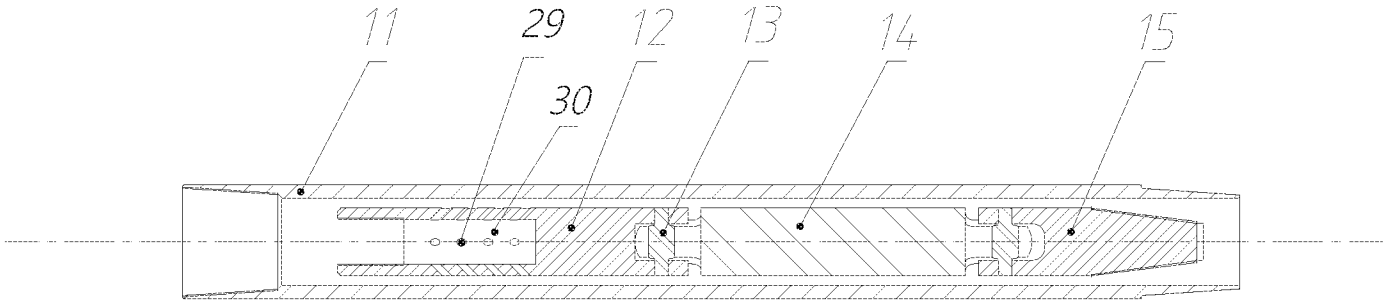
FIG. 3 is a schematic diagram of a universal shaft outer shell and an internal structure thereof.
Figure 4:
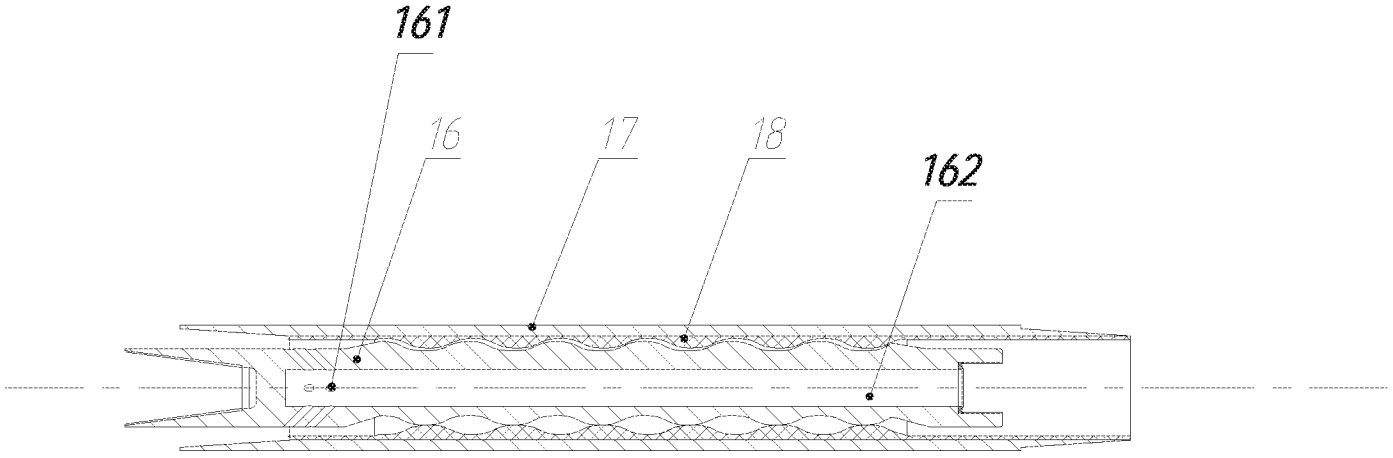
FIG. 4 is a schematic diagram of a stator outer shell and an internal structure thereof.

As shown in FIG. 3, in this embodiment, a specific implementation of the universal shaft assembly 100 is that the universal shaft assembly 100 includes an upper portion of the universal shaft 12, a middle portion of the universal shaft 14, a lower portion of the universal shaft 15, and two cross shafts 13. The upper portion of the universal shaft 12, the middle portion of the universal shaft 14, and the lower portion of the universal shaft 15 are all hinged to the cross shaft 13, and the lower portion of the universal shaft 15 is in threaded connection with the hollow rotor 16; the upper portion of the universal shaft 12 is provided with a channel and a diversion hole 29 that are communicated with the driving shaft 1, and the channel is communicated with a cavity between the universal shaft outer shell 11 and the universal shaft assembly 100 through the diversion hole 29; and the upper portion of the universal shaft 12 is in threaded connection with the driving shaft 1, and the lower portion of the universal shaft 15 is in threaded connection with the hollow rotor 16.

Figure 5:
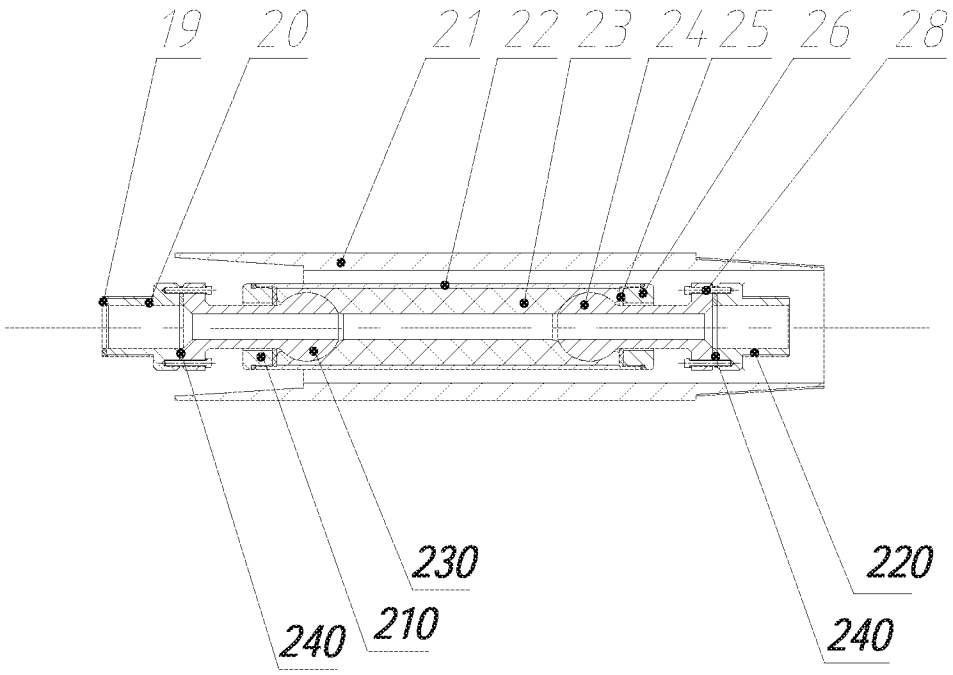
FIG. 5 is a schematic diagram of a middle outer shell and an internal structure thereof.
Figure 6:
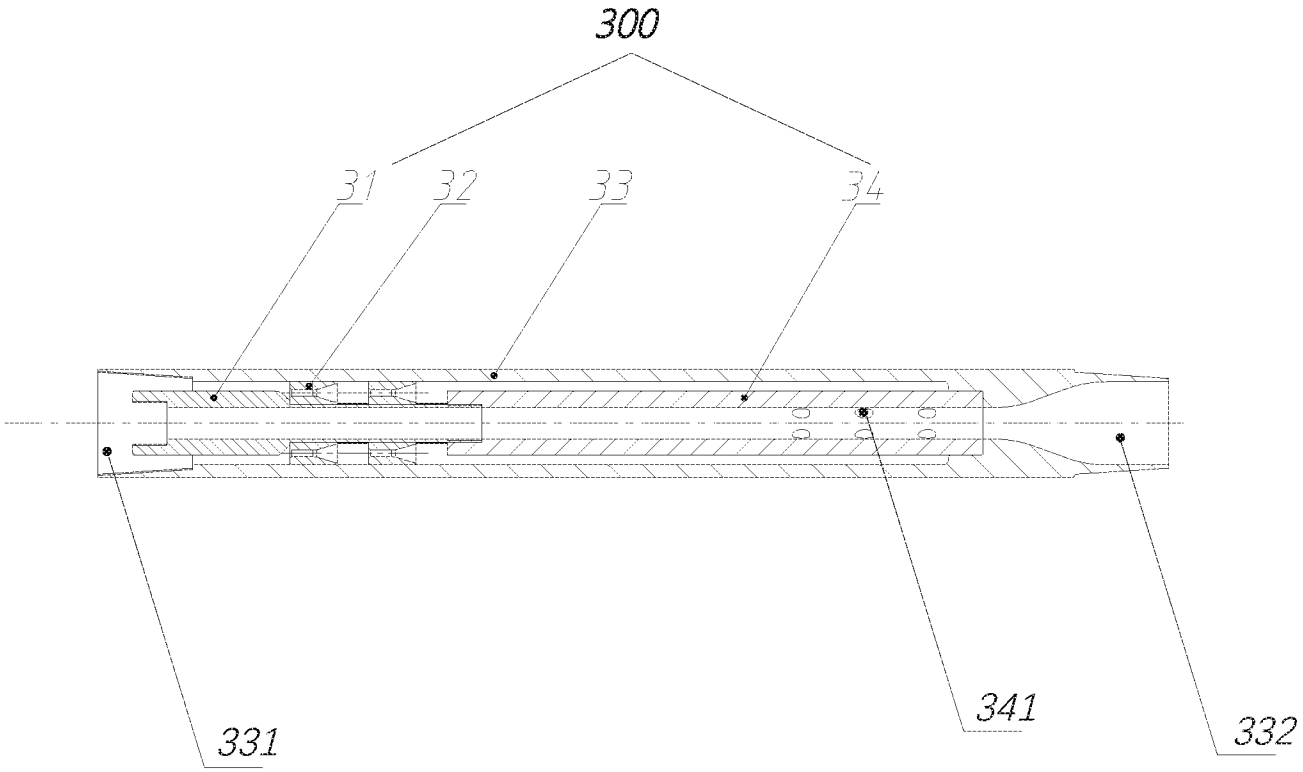
FIG. 6 is a schematic diagram of a lower connector and an internal structure thereof.
Figure 7:
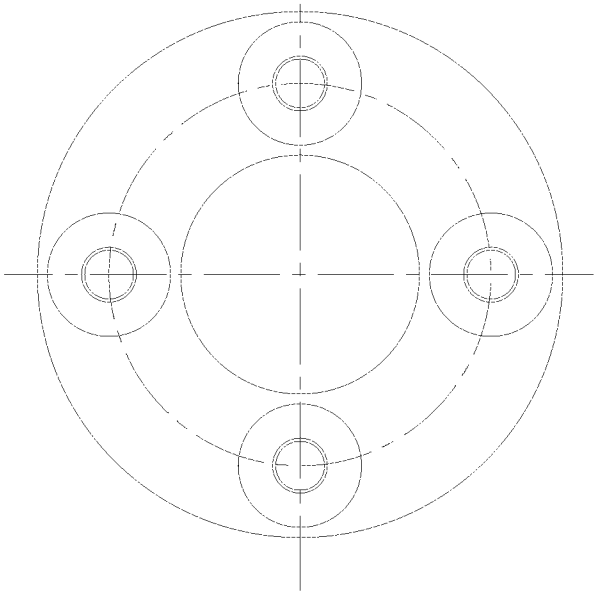
FIG. 7 is a schematic structural diagram of a differential pressure controller.
Figure 8:
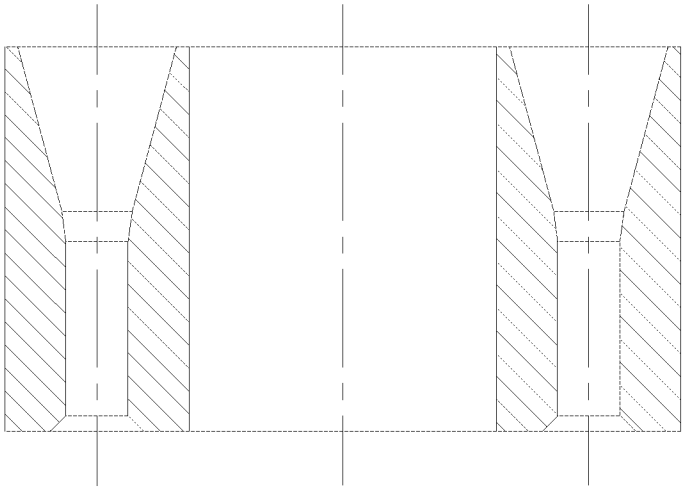
FIG. 8 is a sectional view along A-A direction in FIG. 7.

As shown in FIG. 5, in this embodiment, a specific implementation of the torque separation assembly 200 is that the torque separation assembly 200 includes a left pump rotor conversion connector 20, a left pump flexible shaft 210, a left end cover 230, a rotary sealing outer shell 22, a lining 23, a right pump rotor conversion connector 220, a right pump flexible shaft 24, and a right end cover 26; and the lining 23 is a rubber lining;

the left pump rotor conversion connector 20, the left pump flexible shaft 210, the lining 23, the right pump flexible shaft 24, and the right pump rotor conversion connector 220 are all axially provided with flow channels and are sequentially communicated; and the left pump flexible shaft 210 and the right pump flexible shaft 24 are respectively mounted in a left end and a right end of the lining 23, the lining 23 is mounted in the rotary sealing outer shell 22, and the left end cover 230 and the right end cover 26 are respectively sleeved on the left pump flexible shaft 210 and the right pump flexible shaft 24 and are mounted on a left end and a right end of the rotary sealing outer shell 22; a left end of the left pump rotor conversion connector 20 is connected with the hollow rotor 16, and a right end of the left pump rotor conversion connector is connected with the left pump flexible shaft 210; and a left end the right pump rotor conversion connector 220 is connected with the right pump flexible shaft 24, and a right end of the right pump rotor conversion connector 220 is connected with the confluence assembly 300.

In the embodiment of the torque separation assembly 200, in order to improve the sealing effect, the preferred embodiment is as follows: a pump rotor sealing ring 19 is arranged between the left pump rotor conversion connector 20 and the hollow rotor 16, and between the confluence assembly 300 and the right pump rotor conversion connector 220, a conversion connector gasket 240 is arranged between the left pump rotor conversion connector 20 and the left pump flexible shaft 210 and between the right pump rotor conversion connector 220 and the right pump flexible shaft 24, and a rotary sealing ring 25 is arranged between the rotary sealing outer shell 22 and the left end cover 230 and between the rotary sealing outer shell and the right end cover 26.

As shown in FIG. 5, in the embodiment of the torque separation assembly 200, both the left pump rotor conversion connector 20 and the left pump flexible shaft 210, and the right pump rotor conversion connector 220 and the right pump flexible shaft 24 are connected through a bolt 28.

As shown in FIG. 1, FIG. 6 and FIGS. 11-13, another specific embodiment of the confluence assembly 300 in the embodiment is as follows: the confluence assembly 300 includes a first drilling fluid converging pipe 34 and a second drilling fluid converging pipe 31 which are connected to each other, the first drilling fluid converging pipe 34 and the second drilling fluid converging pipe 31 are mounted in the cavity of the lower connector 33, two ends of the first drilling fluid converging pipe 34 are respectively communicated with an outlet and the second drilling fluid converging pipe 31, one end of the second drilling fluid converging pipe 31 is connected and communicated with the torque separation assembly 200, a differential pressure controller 32 sleeved on the second drilling fluid converging pipe 31 is arranged between an inner wall of the cavity and an outer wall of the second drilling fluid converging pipe, and a confluence hole 341 communicated with the cavity is formed in the second drilling fluid converging pipe 31; and due to the design requirement of the differential pressure controller 32, an outer diameter of a tail end of the second drilling fluid converging pipe 31 is reduced, and the second drilling fluid converging pipe 31 is in threaded connection with the first drilling fluid converging pipe 34. According to the method, the number of the differential pressure controllers 32 can be increased or decreased by changing the length of the tail end of the second drilling fluid converging pipe 31, so that the pressure difference of the drilling fluid and the output torque at two ends are adjusted. Meanwhile, the critical rotating speed of the driving shaft when the output torque and the reverse torque are balanced can be changed by changing the number of the differential pressure controllers 32. The flow area of the fluid between the second drilling fluid converging pipe 31 and the lower connector 33 is reduced, and the flow rate of the drilling fluid is increased, so that the drilling fluid can be quickly converged into the lower drilling tool.

In this way, the drilling fluid flowing into the screw clearance cavity passes through the torque separation assembly 200 and the differential pressure controller 32. The flow area of the differential pressure controller changes, so that when the drilling fluid flows through the differential pressure controller, a certain pressure difference is generated, and the pressure of the drilling fluid before the differential pressure controller is greater than the pressure of the drilling fluid behind the differential pressure controller. The plurality of differential pressure controllers 32 can be added by changing the size of the second drilling fluid converging pipe 31, so as to enable the drilling fluid to generate different pressure differences.

Due to the effect of the differential pressure controller, the pressure of the drilling fluid flowing into the screw clearance cavity is larger than the pressure of the drilling fluid of the center pipeline. The screw stator 18 adopts an equidistant line type of an ordinary inner cycloid, and under the effect of the pressure difference of the drilling fluid, the screw stator 18 outputs a torque to the stator outer shell 17, and the torque is balanced with the reverse torque of the lower drilling tool. The torque is related to the rotating speed of the driving shaft and the number of differential pressure controllers 32. The faster the rotating speed of the driving shaft 1, the larger the flow of the drilling fluid flowing into the screw clearance cavity, and the higher the pressure difference of the drilling fluid at the two ends, that is, the larger the output torque of the stator. The output torque of the hydraulic torque converter can be adjusted by adjusting the rotating speed of the driving shaft 1.

When in a "directional drilling" mode, the rotating speed of the driving shaft 1 is adjusted, so that the output torque is balanced with the reverse torque of the lower drilling tool, that is, the upper drill string rotates, the lower drill string keeps sliding drilling, the shell of the tool does not rotate, and at the moment, the hydraulic torque converter is in an "off" state.

When in a "compound drilling" mode, the rotating speed of the driving shaft 1 is increased, so that the output torque is larger than the sum of the reverse torque and the friction torque of the lower drilling tool, that is, the full-well drill string is in a rotating state, the shell of the tool also performs a forward rotation movement, and at the moment, the hydraulic torque converter is in a "closed" state.

Figure 9:
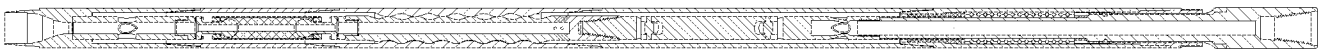
FIG. 9 is a schematic structural diagram of another embodiment of the present invention.
Figure 10:
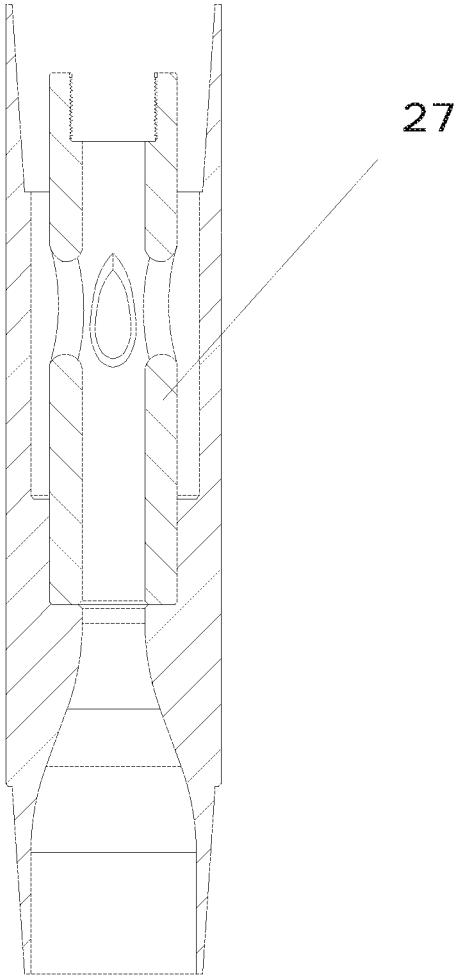
FIG. 10 is a schematic structural diagram of a confluence connector.
Figure 11:
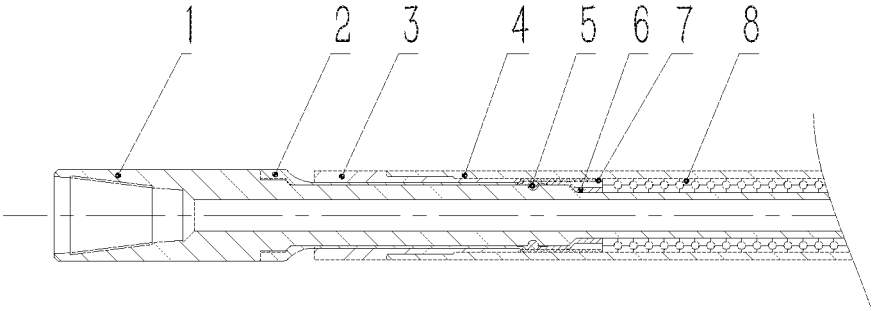
FIG. 11 is a schematic structural diagram of the front section of the structure shown in FIG. 1.
Figure 12:
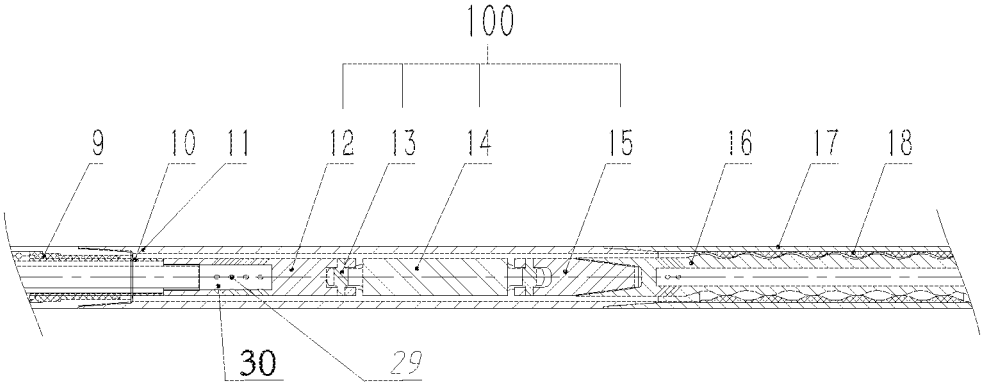
FIG. 12 is a schematic structural diagram of the middle section of the structure shown in FIG. 1.
Figure 13:
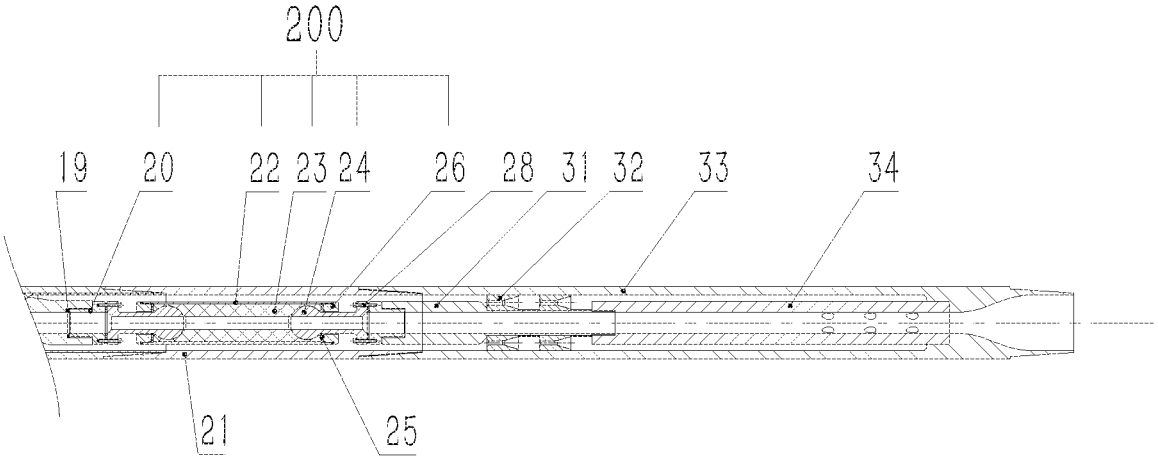
FIG. 13 is a schematic structural diagram of the rear section of the structure shown in FIG. 1.

As shown in FIG. 9 and FIG. 10, in this embodiment, a specific embodiment of the confluence assembly 300 is a confluence connector 27. A plurality of confluence holes 341 are formed in the confluence connector 27 in a radial direction; and the drilling fluid that flows into the screw clearance cavity and the drilling fluid in the internal flow channel 162 of the hollow rotor 16 are re-gathered together at the confluence connector 27 and flow to the lower drill string.

The above-described constitutes no restriction in any form on the present invention. Although the present invention has been disclosed by the above embodiments, such exemplary embodiments are not intended to limit the present invention, and those skilled in the art can make some changes or modifications to equivalent embodiments with equivalent changes by reference to the technical content disclosed above without departing from the scope of the technical solutions of the present invention. However, any simple revisions, equivalent changes, and modifications made to the above embodiments in accordance with the technical essence of the present invention without departing from the content of the technical solutions of the present invention shall still fall within the scope of the technical solutions of the present invention.

What is claimed is:

1. A mechanical hydraulic torque converter for a horizontal well, comprising a hollow driving shaft, an upper outer shell, a driving shaft positioning shell, bearing assembly, a universal shaft outer shell, a universal shaft assembly, a stator outer shell with a screw stator, a hollow rotor, a middle outer shell, a torque separation assembly, a lower connector, and a confluence assembly;

the hollow driving shaft is mounted and fixed in the upper outer shell through the driving shaft positioning shell and the bearing assembly; and the universal shaft assembly is mounted in the universal shaft outer shell, and two ends of the universal shaft assembly are respectively connected with the hollow driving shaft and the hollow rotor;

the universal shaft assembly is provided with a diversion hole and a diversion cavity, a flow channel of the hollow driving shaft is communicated with the diversion cavity, and the diversion cavity is communicated with a gap between the universal shaft outer shell and the universal shaft assembly through the diversion hole;

the hollow rotor is mounted in the stator outer shell, one end of the hollow rotor is connected and communicated with the torque separation assembly mounted in the middle outer shell, and a drainage hole is formed in the other end of the hollow rotor; and a flow channel of the hollow rotor is communicated with a gap between the hollow rotor and the stator outer shell through the drainage hole;

a left end of the lower connector is provided with an outlet, and a right end of the lower connector is provided with a cavity communicated with the outlet; the confluence assembly is mounted in the cavity of the lower connector, one end of the confluence assembly is connected and communicated with the torque separation assembly, the other end of the confluence assembly is communicated with the outlet of the lower connector, and a confluence hole communicated with the cavity is formed in the confluence assembly;

the upper outer shell, the universal shaft outer shell, the stator outer shell, the middle outer shell, and the lower connector are sequentially connected;

the torque separation assembly comprises a left pump rotor conversion connector, a left pump shaft, a left end cover, a rotary sealing outer shell, a lining, a right pump rotor conversion connector, a right pump shaft, and a right end cover;

the left pump rotor conversion connector, the left pump shaft, the lining, the right pump shaft, and the right pump rotor conversion connector are all axially provided with flow channels and are sequentially communicated; and the left pump shaft and the right pump shaft are respectively mounted in a left end and a right end of the lining, the lining is mounted in the rotary sealing outer shell, and the left end cover and the right end cover are respectively sleeved on the left pump shaft and the right pump shaft and are mounted on a left end and a right end of the rotary sealing outer shell; a left end of the left pump rotor conversion connector is connected with the hollow rotor, and a right end of the left pump rotor conversion connector is connected with the left pump shaft; and a left end the right pump rotor conversion connector is connected with the right pump shaft, and a right end of the right pump rotor conversion connector is connected with the confluence assembly;

wherein the bearing assembly comprises a bearing moving ring, a lower baffle ring, an upper baffle ring, an upper sleeve, a bearing, a bearing static ring, and a bearing baffle ring, the bearing moving ring, the lower baffle ring, the upper baffle ring, the bearing, and the bearing baffle ring are sequentially sleeved on the hollow driving shaft, the upper sleeve is sleeved on the lower baffle ring and the upper baffle ring, and right ends of the upper baffle ring and the upper sleeve are both tightly attached to a left end surface of the bearing; the driving shaft positioning shell is sleeved on the bearing moving ring and is in threaded connection with an interior of the upper outer shell, and a left end of the driving shaft positioning shell is tightly attached to a left end of the upper sleeve; the bearing static ring is sleeved on the bearing baffle ring, and a left end of the bearing static ring is tightly attached to a right end surface of the bearing; and a right end of the bearing baffle ring is tightly attached to a left end of the universal shaft assembly.

2. The mechanical hydraulic torque converter for a horizontal well according to claim 1, wherein the universal shaft assembly comprises an upper portion of the universal shaft, a middle portion of the universal shaft, a lower portion of the universal shaft, and two cross shafts; the upper portion of the universal shaft, the middle portion of the universal shaft, and the lower portion of the universal shaft are all hinged to the cross shaft, and the lower portion of the universal shaft is in threaded connection with the hollow rotor; the upper portion of the universal shaft is provided with a channel and a diversion hole that are communicated with the hollow driving shaft, and the channel is communicated with a cavity between the universal shaft outer shell and the universal shaft assembly through the diversion hole; and the upper portion of the universal shaft is in threaded connection with the hollow driving shaft, and the lower portion of the universal shaft is in threaded connection with the hollow rotor.

3. The mechanical hydraulic torque converter for a horizontal well according to claim 1, wherein the confluence assembly comprises a confluence connector, and a plurality of confluence holes are formed in the confluence connector in a radial direction.

4. The mechanical hydraulic torque converter for a horizontal well according to claim 1, wherein the confluence assembly comprises a first drilling fluid converging pipe and a second drilling fluid converging pipe which are connected to each other, the first drilling fluid converging pipe and the second drilling fluid converging pipe are mounted in the cavity of the lower connector, two ends of the first drilling fluid converging pipe are respectively communicated with an outlet and the second drilling fluid converging pipe, one end of the second drilling fluid converging pipe is connected and communicated with the torque separation assembly, a differential pressure controller sleeved on the second drilling fluid converging pipe is arranged between an inner wall of the cavity of the lower connector and an outer wall of the second drilling fluid converging pipe, and a confluence hole communicated with the cavity of the lower connector is formed in the second drilling fluid converging pipe.

5. The mechanical hydraulic torque converter for a horizontal well according to claim 1, wherein a pump rotor sealing ring is arranged between the left pump rotor conversion connector and the hollow rotor and between the confluence assembly and the right pump rotor conversion connector.

6. The mechanical hydraulic torque converter for a horizontal well according to claim 1, wherein a conversion connector gasket is arranged between the left pump rotor conversion connector and the left pump shaft and between the right pump rotor conversion connector and the right pump shaft.

7. The mechanical hydraulic torque converter for a horizontal well according to claim 1, wherein both the left pump rotor conversion connector and the left pump shaft, and the right pump rotor conversion connector and the right pump shaft are connected through a bolt.

8. The mechanical hydraulic torque converter for a horizontal well according to claim 1, wherein a rotary sealing ring is arranged between the rotary sealing outer shell and the left end cover and between the rotary sealing outer shell and the right end cover.

* * * * *